US006824113B1

(12) United States Patent
Gee et al.

(10) Patent No.: US 6,824,113 B1
(45) Date of Patent: Nov. 30, 2004

(54) POST SUPPORT SYSTEM ESPECIALLY FOR A MAILBOX

(76) Inventors: James L. Gee, 1178 Carter Rd., Midland, MI (US) 48642; Christopher John Rudy, 3225 S. Shoreview Dr., Ft. Gratiot, MI (US) 48059

( * ) Notice: Subject to any disclaimer, the term of this patent is extended or adjusted under 35 U.S.C. 154(b) by 0 days.

(21) Appl. No.: 10/165,248

(22) Filed: Jun. 7, 2002

Related U.S. Application Data

(60) Provisional application No. 60/297,063, filed on Jun. 8, 2001, and provisional application No. 60/297,064, filed on Jun. 8, 2001.

(51) Int. Cl.[7] ..... A47B 96/06

(52) U.S. Cl. ..... 248/218.4

(58) Field of Search ..... 248/218.4, 219.2, 248/219.3, 219.4; 232/17, 38, 39, 1 A, 1 C; 211/10, 11, 126.5, 126.12; D99/31, 32, 33

(56) References Cited

U.S. PATENT DOCUMENTS

| | | | | | |
|---|---|---|---|---|---|
| 391,293 | A | | 10/1888 | Black | |
| 1,004,476 | A | | 9/1911 | Schultz | |
| 1,204,494 | A | | 11/1916 | Sare | |
| 2,552,915 | A | | 5/1951 | Zachrich | 248/221 |
| 2,709,083 | A | | 5/1955 | Marcus et al. | 232/17 |
| D190,939 | S | * | 7/1961 | Herbian | D99/32 |
| 3,107,848 | A | | 10/1963 | Penta | 232/17 |
| D213,738 | S | | 4/1969 | Andis | D6/1 |
| 3,658,241 | A | | 4/1972 | Pistocchi | 232/1 R |
| 3,888,409 | A | * | 6/1975 | Bolduc | 232/1 C |
| 4,120,446 | A | * | 10/1978 | Fuemmeler | 232/17 |
| 4,187,978 | A | | 2/1980 | Dowker | 232/39 |
| 4,213,560 | A | * | 7/1980 | Hall | 232/39 |
| D263,514 | S | * | 3/1982 | Paparella | D99/32 |
| 4,368,842 | A | | 1/1983 | DeLange, III | 232/17 |
| 4,660,757 | A | * | 4/1987 | Hicks | 232/1 C |
| 4,915,293 | A | * | 4/1990 | Paramski | 232/39 |
| 4,955,533 | A | * | 9/1990 | Merkel | 232/39 |
| 5,035,356 | A | | 7/1991 | Granger | 232/17 |
| 5,053,274 | A | | 10/1991 | Jonas | 428/332 |
| 5,067,650 | A | | 11/1991 | Jones et al. | 232/17 |
| D324,444 | S | * | 3/1992 | Cummings | D99/31 |
| 5,178,321 | A | | 1/1993 | Majewski | 232/17 |
| 5,247,282 | A | * | 9/1993 | Marshall | 340/569 |
| 5,356,072 | A | | 10/1994 | Thomas | 232/39 |
| 5,411,206 | A | | 5/1995 | Latham et al. | 232/39 |
| 5,460,326 | A | | 10/1995 | Albanesius | 232/39 |
| 5,465,902 | A | * | 11/1995 | Hanson | 232/33 |
| 5,497,888 | A | * | 3/1996 | Michaels et al. | 211/10 |

(List continued on next page.)

OTHER PUBLICATIONS

U.S Provisional Application Ser. No. 60/297,063, Gee, filed Jun. 8, 2001.

U.S. Provisional Application Ser. No. 60/297,064, Gee et al., filed Jun. 8, 2001.

Aickinstrut, Technical Information, pp. 7–9 and 16.

B–Line Systems, Inc., Channel and Fittings, pp. 14, 15, 50, 51, 80, 81, 130, 131, 134 and 135.

*Primary Examiner*—Alfred J Wujciak

(74) *Attorney, Agent, or Firm*—Christopher John Rudy

(57) ABSTRACT

Newsbox post support system includes an upright newsbox support member attached to a mailbox support, to which is attached at least one newsbox. A guard member may be included so as to guard the mailbox and/or newsbox(es) from road damage such as caused by plowed snow. The newsbox support system can be fulfilled with a post support comprising a support body having a subsurface contact flange in connection with a post-receiving restraint. The post support is useful to mount and support a post such as that of the mailbox, that of a separately mounted newsbox set and/or for other applications such as a fence, bird feeder or bird bath. The post support can be permanently installed in the ground, or it can be temporarily installed on the ground. The post support and the post can be combined. A weed control collar may be employed with the post.

20 Claims, 5 Drawing Sheets

U.S. PATENT DOCUMENTS 5,524,858 A * 6/1996 Friend ..... 248/548
5,575,422 A 11/1996 Peterman ..... 232/38
D376,891 S 12/1996 Wooten, Jr. et al. ..... D99/31
5,593,059 A * 1/1997 Neilson ..... 220/229
5,664,729 A * 9/1997 Ladewig ..... 232/39
D399,034 S * 9/1998 Duane ..... D99/31
5,855,342 A * 1/1999 Hawkins et al. ..... 248/68.1
5,901,507 A * 5/1999 Smeja et al. ..... 52/24
5,984,172 A 11/1999 Easterwood ..... 232/38
6,090,466 A 7/2000 Kartisek
6,123,257 A 9/2000 Guidicy ..... 232/17
6,155,441 A * 12/2000 Andersen et al. ..... 211/192
6,276,869 B1 * 8/2001 Yakushinji ..... 404/9

* cited by examiner

POST SUPPORT SYSTEM ESPECIALLY FOR A MAILBOX

CROSS-REFERENCE CLAIM OF PRIORITY

This claims benefit under 35 USC 119(e) of U.S. provisional patent application Nos. 60/297,063 and 60/297,064 which were both filed on Jun. 8, 2001 A.D. The complete specifications of those applications are incorporated herein by reference.

FIELD AND PURVIEW

The present invention concerns a system and support, useful for providing a receptacle for receiving mail or other material such as newspapers and advertising papers, with a supporting post such as that for a mailbox and/or newsbox. It concerns a post support, useful for supporting a post, for example, that of the mailbox. The post may be permanently or temporarily installed in or on the ground. It can also concern the combination of the newsbox post and mailbox post supports, and/or the post support and the post. A weed control collar can be of concern as well.

BACKGROUND ART

Rural mailboxes are typically supported by a post, commonly, for example, a treated wooden four-by-four, which is driven into the ground alongside the roadway. A problem with the arrangement is that not uncommonly the post breaks, and to replace the post requires wrenching the broken post from the ground and replacing it with a new post in a new or reconditioned hole. This meets with varied levels of success but is always quite time consuming. The problem escalates when, as often occurs, the post is broken during a cold, snowy winter. Then too, during spring, summer and fall, grass or other vegetation grows alongside the post, and it can be aggravating to trim around the post when mowing the lawn.

Also, snow or other road damage may occur to the mailbox, especially from road plows. See, e.g., U.S. Pat. Nos. 391,293; 1,004,476; 1,204,494; 2,552,915; 2,709,038; 3,107,848; 3,658,241; 4,187,978; 4,368,842; 4,995,533; 5,035,356; 5,067,650; 5,178,321; 5,356,072; 5,411,206; 5,460,326; 5,575,422; 5,984,172; 6,123,257.

Furthermore, rural newspaper delivery is often accomplished through use of a newsbox, which frequently is made of plastic and is tacked to the mailbox post, singly or in tandem if, say, different newspapers are to be delivered. Alternatively, a metal fence post having two newsboxes is driven in adjacent the mailbox. In either case, the arrangement is unsightly, and the newsboxes can be placed too low for ready delivery of the news.

It would be desirable to ameliorate or solve such problems.

GENERAL SUMMARY

The present invention provides a newsbox post support system comprising an upright newsbox support member attached to a mailbox support, to which is attached at least one newsbox. The newsbox support system can be beneficially fulfilled with a post support comprising a support body having a subsurface contact flange in connection with a post-receiving restraint. The post support is useful for mounting and supporting a post such as that of the mailbox, that of a separately mounted newsbox set and/or for other applications such as a fence, bird feeder or bird bath. In one embodiment, the post support can be permanently installed in the ground, and, in another embodiment, it can be temporarily installed on the ground. Also provided, accordingly, is the combination of the post support and the post. As well, a weed control collar is provided, which may be employed with the post.

Significantly, by the invention, problems in the art are ameliorated if not solved outright. In particular, mounting of the newsbox set, particularly when the set includes more than one newsbox, is made more pleasant, uniform, secure, and at a height conducive to more ready delivery of the newspaper, advertising sheet, or other material. Also, replacement of a broken mailbox or newsbox post can be effected with speed and efficiency, even in inclement weather. Thus, a post broken in the winter can be replaced then and there, without having to wait until the spring thaw. Numerous further advantages attend the invention.

DRAWINGS IN BRIEF

The drawings form part of the present specification. With respect to the drawings, which are not necessarily drawn to scale, the following is briefly noted:

ILLUSTRATIVE DETAIL

Figure 1:
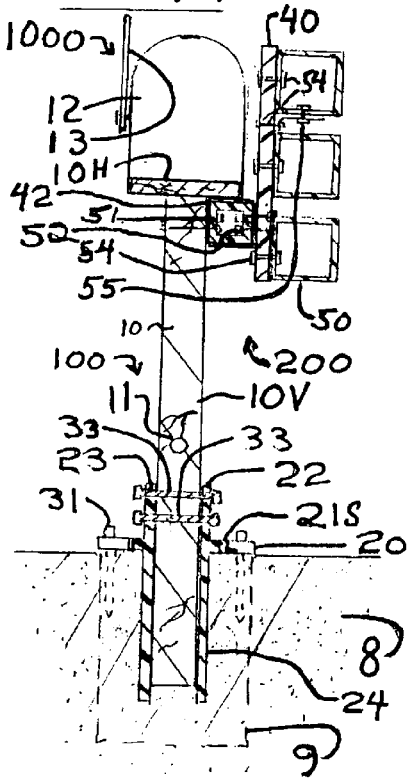
FIG. 1 is a rear, sectional view of a newsbox post support system embracing an upright newsbox support member attached to a mailbox support, to which is attached at least one newsbox. The newsbox support system includes its presence in combination with a post support which embraces a support body having a subsurface contact flange in connection with a post-receiving restraint.

The invention can be further understood by the present detail, which may be read in view of the drawings. Such is to be taken in an illustrative and not necessarily limiting sense.

With respect to the drawings, post 10, for example, a wooden four-by-four, which may have post breakaway hole 11 drilled therethrough, supports rural mailbox 12 having signal flag 13. The post 10 is generally vertical; however, as a support, it may have a horizontal component 10H and a vertical component 10V. The post and mailbox subcombination 10, 12 may be supported by a post support 100 in the practice of the invention. Accompanying the subcombination 10, 12 is newsbox post support system 200. A combination of the subcombination 10, 12 with the support 100 and the newsbox post support system 200, provides full system 1000.

Figure 2:
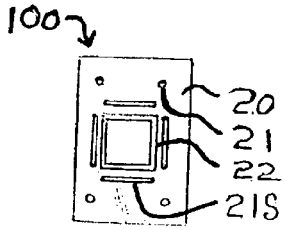
FIG. 2 is a top view of the post support seen within FIG. 1.
Figure 3:
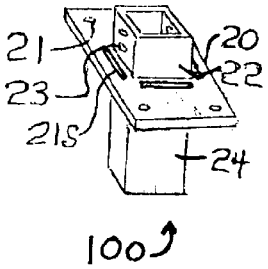
FIG. 3 is a perspective view of the post support of FIG. 2.
Figure 4:
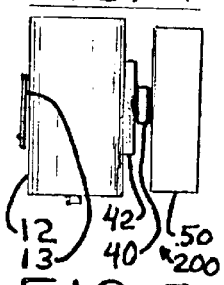
FIG. 4 is a top view of the system depicted in FIG. 1.
Figure 21:
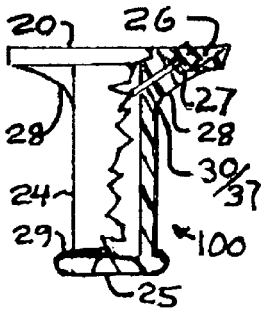
FIG. 21 is a side view, in partial section, of another embodiment of a post support of the invention.
Figure 22:
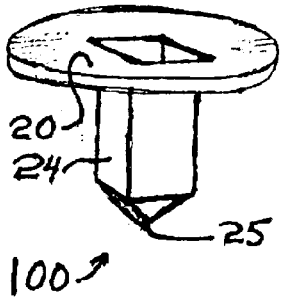
FIG. 22 is a perspective view of another embodiment of a post support of the invention.
Figure 23:
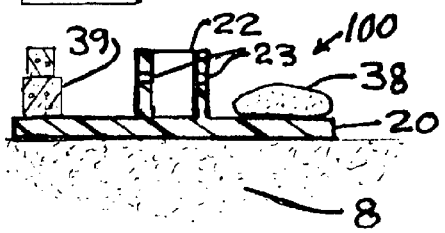
FIG. 23 is a side, sectional view of another embodiment of a post support of the invention.
Figure 24:
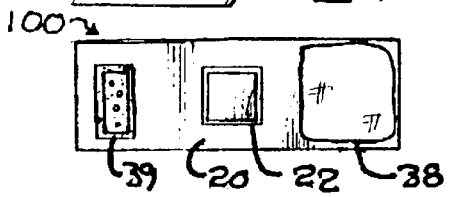
FIG. 24 is a top view of the post support of FIG. 6.
Figure 25:
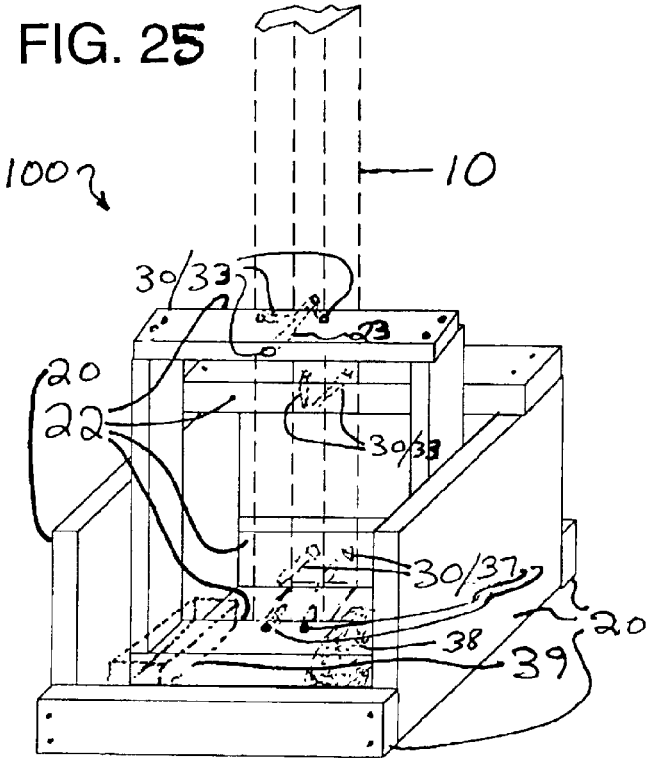
FIG. 25 is a perspective view of another embodiment of a post support of the invention, in an environment supporting a post.
Figure 26:
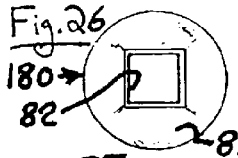
FIG. 26 is a top view of a post weed control collar which may be employed in the practice of the invention.
Figure 27:
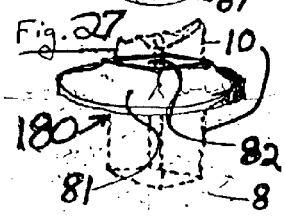
FIG. 27 is a perspective view of the collar of FIG. 26, shown in an environment in place on the ground around a post which is emplaced in the ground.

A suitable post support 100 embraces a support body having subsurface contact flange 20, which may have hole (s) 21 provided therethrough so as to facilitate provision of a more firm mount to the ground 8, which may serve as the subsurface, and/or soil-packing orifice(s) 21S, which hole(s) and/or orifice(s) may be of the knock out variety or be permanent. The ground 8 may be soil (which may be locally compacted or loose) or concrete that may reside within concrete volume boundary 9. The flange 20 exists in connection with a post-receiving restraint-such as above ground post collar 22, which may have hole(s) 23 provided therethrough, which hole(s) 23 may be of the knock out variety or be permanent, so as to facilitate securement of the post 10, 10V thereto; and/or below ground post collar 24 which may be open bottomed (FIGS. 1–3) or closed bottomed (FIGS. 21, 22), the latter being provided with bottom 25. The below ground post collar 24 especially, and beneficially when it is provided as the open bottomed version, may have any bottom 25 cut off and/or part of the collar 24 cut short to accommodate the convenient depth of a hole when it is placed in the ground 8. In general, the collars 22, 24 closely fit the post 10. The closed bottomed below ground post collar 24 may have bottom 25 which is flat (FIG. 21) or spiked (FIG. 22). Flange recess 26 (FIG. 21) may be provided in the flange 20, which recess leads to shoulder hole 27, which hole may be of the knock out variety or be-permanent, to the below ground post-receiving restraint 24 portion. Reinforcing buttress(es) 28 may be provided, notably spanning from the underside of the flange 20 to the side of the below ground restraint 24. Protuberance(es) 29 may be provided on the outer surface of the below ground restraint 24 so as to provide a catch or wedge for a better soil or concrete hold for the post support 100 or combination with the post support 100. Not only does the flange 20 provide for lateral support which-translates into vertical support of the post 10, but also it can provide for a collar through which grass, weeds or other plant life cannot grow. Thus, close trimming of the post 10 installed in the device 100 is obviated as a pass with the ordinary lawn mower suffices to keep the area about the combination of the invention neat and tidy. Fastener(s) 30 such as one or more of a peg, pin or spike 31 inserted through the hole(s) 21 may assist in securing the device 100 to the ground 8; one or more of peg, pin, bolt, screw or nail 33, 37, say, inserted through the hole(s) 23, 27 may assist in securing the device 100 to the post 10. Sand bag(s) 38 and/or concrete block(s) or brick(s) 39 may be used to effect notably in temporary cases. An on-the-ground, temporary post support may be provided by cutting off or otherwise not providing the collar 24 (FIGS. 23, 24) or by providing a boxlike frame (FIG. 25), for example, wood, which temporary device would typically be weighted, say, with blocks, bricks and/or sand bags placed on top of the flange 20. Alternatively, the on-the-ground temporary post support may be made from a heavy material such as metal or a plastic, especially one with a heavy filler so to not require it being weighted extrinsically. In general, the collars 22, 24 can, and beneficially do, closely fit the post 10, 10V, especially to confine it on all sides or at least as many as will keep a post from tilting to one side or another. See, FIG. 1; compare, FIGS. 2, 3, 21–24. However, the collar 22 need not so confine the post 10 (FIG. 25) in which case the post 10 is fully restrained by the fasteners 30, 33, 37 such as nails or screws.

Post weed control collar 180, which may serve as a weed collar about a post that is already supported or serve as a post support in appropriate circumstances such as when it may be heavy enough or otherwise have feature(s) such as set forth above in order to accomplish this, has flange 81 and post hole 82 through which the post 10, say, of the 4×4 variety, may be put. As an alternative, the collar can be slipped over an installed post. The collar 180 (as well as any laterally extending collar of the post support flange 20) may have its flange 81 of any suitably shaped peripheral boundary, for instance, circular, elliptical, triangular, square, rectangular, pentagonal, hexagonal and so forth, with the hole 82 corresponding to and tightly fitting the profile of the post, for instance, being square and properly sized to control weeds about a 4×4 post, or circular or other shape to control weeds about the cylindrical posts for a chain link or split rail fence.

Figure 5:
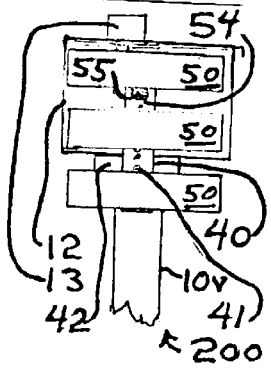
FIG. 5 is a side view of the system depicted in FIGS. 1 & 4.
Figure 6:
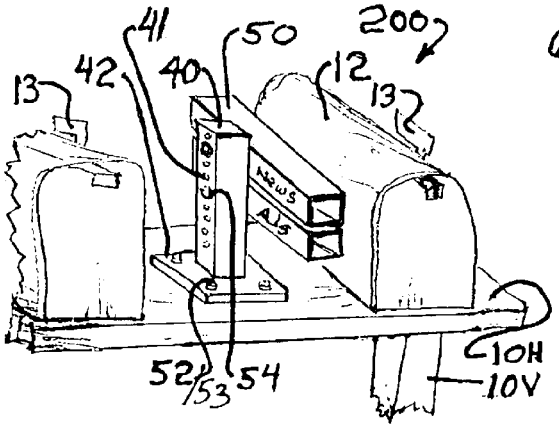
FIG. 6 is a perspective view of another embodiment of a newsbox post support system of the invention. The same is, provided with a gang-style mailbox arrangement.
Figure 7:
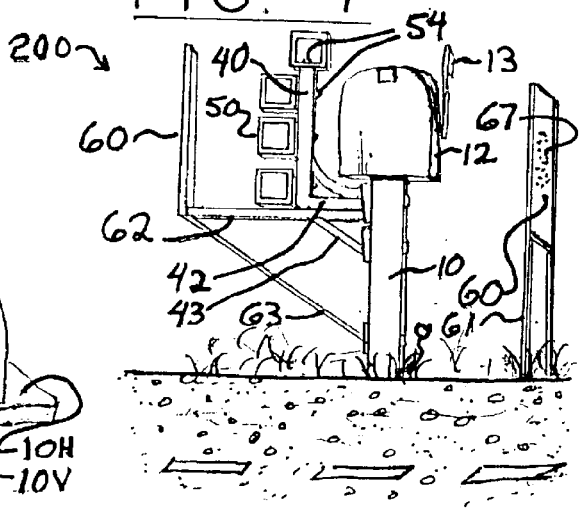
FIG. 7 is a front, perspective view of another embodiment of a newsbox post support system. This embodiment further includes provision of one or more snow guards for and part of the system, with these snow guards mounted outside the newsboxes and mailbox.
Figure 8:
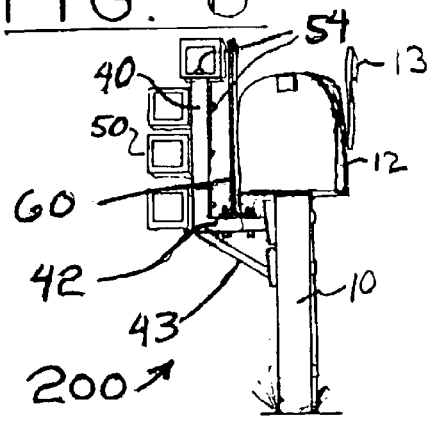
FIG. 8 is a front, perspective view of another embodiment of a newsbox support system with a snow guard mounted between the newsboxes and the mailbox.
Figure 9:
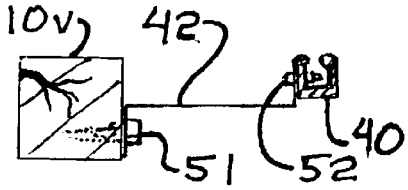
FIG. 9 is a top view in partial section of an embodiment of the invention employing a standard, commercially available 8-inch length horizontal Z-bar newsbox mounting member, say, of steel.
Figure 10:
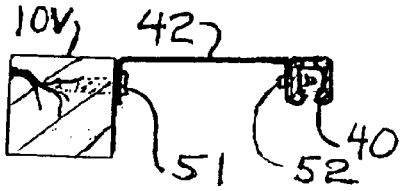
FIG. 10 is a top view in partial section of an embodiment of the invention having a horizontal U-bar newsbox mounting member.
Figure 11:
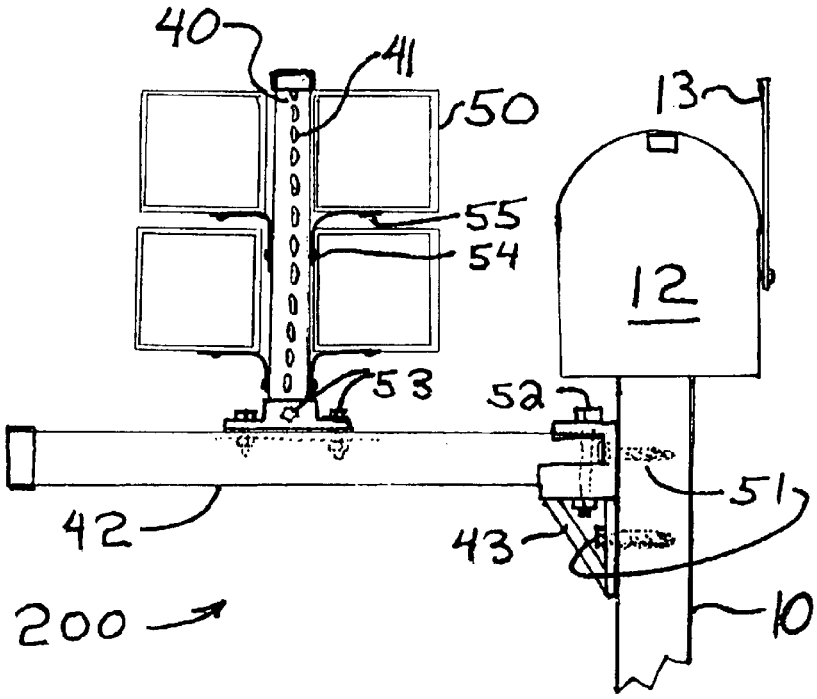
FIG. 11 is a front view of another embodiment of a newsbox support system of the invention. In this embodiment, standard bolted metal framing system channels and brackets are employed.
Figure 12:
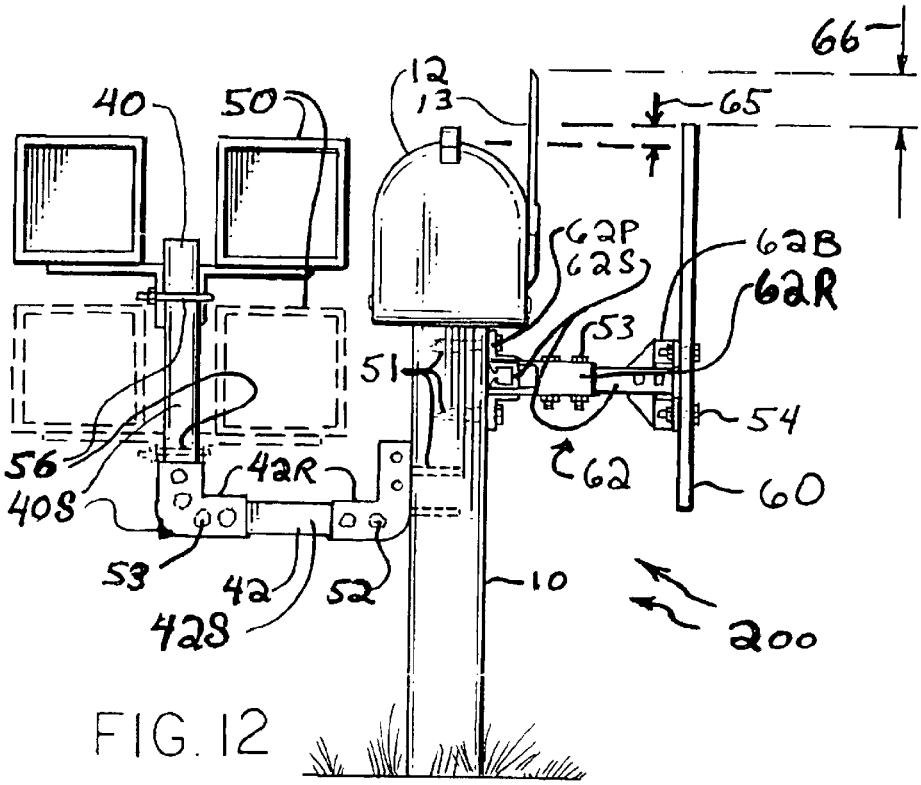
FIG. 12 is a front view of another embodiment of a mailbox support and guard system of the invention that employs reinforced plastic strut and connectors. Compare, FIGS. 1 & 4–11.
Figure 13:
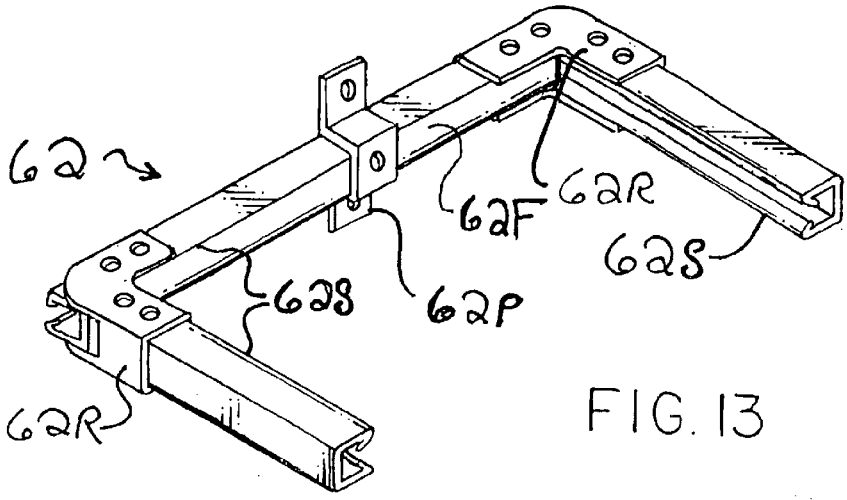
FIG. 13 is a top perspective view of the snow guard and/or sign support subsystem employed within the system of FIG. 12.
Figure 14:
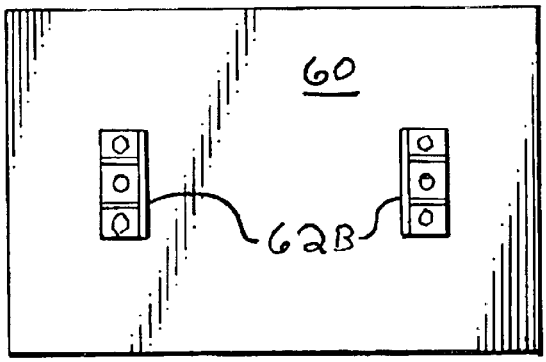
FIG. 14 is an elevational view of the snow guard and/or sign with strut receiving brackets found within the system of FIG. 12.
Figure 15:
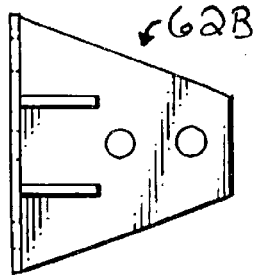
FIG. 15 is a side view of the strut receiving bracket found within FIG. 14, rotated ninety degrees.
Figure 18:
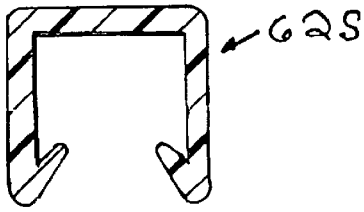
FIG. 18 is a cross-sectional view of a strut member found within the system of FIG. 12.
Figure 16:
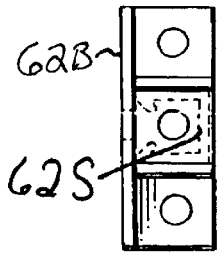
FIG. 16 is a rear plan view of the strut receiving bracket found within FIGS. 12 & 14, in receipt of a strut.
Figure 19:
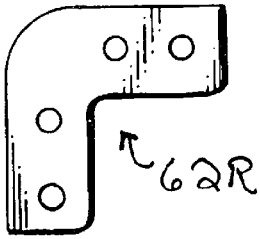
FIG. 19 is a side view of a L-forming strut connector employed within the system of FIG. 12 and subsystem of FIG. 13.
Figure 20:
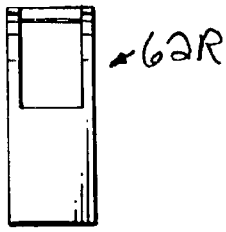
FIG. 20 is a rear view of the connector of FIG. 19.
Figure 17:
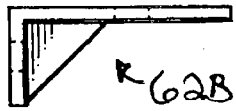
FIG. 17 is a top view of the bracket of FIG. 15.

The newsbox post support system 200 includes upright newsbox support member 40, which may include a plurality of holes 41 or slot(s) for versatility in mount positioning. The support member 40 is attached to the mailbox support, say, the post 10H or 10V through stabilizing mount 42. The member 40 and mount 22 may be made of pieces, for example, fiber-reinforced plastic fittings such as to include right-angle connecters 42R, and strut members 40S, 42S, for instance, with the strut member 40S being some thirteen to sixteen, for example, about fourteen, inches, and the strut member 42S being some seven to ten, for example, eight, inches (FIG. 12). The mount 42 may be buttressed by brace 43 (FIG. 8). To the member 40 is attached at least one newsbox 50. Mounting, to include mounting of the connecters and strut members 40S, 42R, 42S may be accomplished by any suitable ways or means such as gluing, riveting, screwing, nailing, stapling, and so forth, for example, by employing lag-screw or bolt-type fasteners 51, 52, 53, 54, 55, etc., which may be employed in conjunction with vertical to horizontal mounts, say, of an L-shape, as may be desired (FIGS. 1, 5, 11). U-bolt 56, which may be of the square variety, is advantageously employed to mount the newsbox(es) 50, especially when employing the strut member 40S which is made of a non-metallic material such as a plastic. The highest newsbox 50 may be mounted at a height such that the flag 13 remains visible when signaling for mail pickup, which can be readily accomplished with the present system 200 in a variety of mailbox sizes owing to its variable positioning capability such as may be provided through the mounting holes 41. Preferably, in turn, two standard lull plastic newsboxes are the most which are stacked vertically when the horizontal mount 42 is set just below the bottom of the box 10. Notwithstanding the foregoing, a two-box (horizontal) embodiment (one newsbox high) may have a height to its member 40 of, say, ten inches, and a four-box (one box 50 on top of one other) embodiment may have a height to its member 40 of, say, twenty inches, when the support 42 is mounted just underneath the mailbox 12, and the horizontal support 42 may extend some eighteen inches from the mailbox post 10. However, any suitable dimensions may be employed, to include the eight and fourteen inch strut lengths given above, and these may depend on various factors, including the size of the mailbox 12 and any post or horizontal support 10V, 10H, and the materials employed. Also, or as an option by itself, guard(s) 60 from plowed snow may be provided. These may have post(s) 61, which may be of a standard, sufficiently strong metal or plastic fence post variety or be of the 4×4 type such as the mailbox post 10 may be. A preferred material for the guard 60, owing to considerations of economy and performance, is an outdoor-type, water-resistant, treated plywood, say, eighteen inches by twenty-four inches by one half of an inch. In the latter case, the post 61 may be mounted in the ground through a support body with the subsurface contact flange 20 and so forth as seen above and in the drawings. Snow guard horizontal stabilizing mount 62 may be provided. The mount 62 may be made of pieces, for example, fiber-reinforced plastic fittings such as bracket 62B, post-connecters 62P, right-angle connecters 62R, and strut members 62S (FIGS. 12–20). In the configuration depicted in FIGS. 12 & 13, the single strut member 62S intended to run perpendicular to the road has its solid face 62F abutting the two strut members 62S intended to run parallel with the road and be directly connected to the guard 60 by the brackets 62B so that great strength is provided when assembled; the latter two struts 62S are preferably about eight inches in length, and, in turn, the distance of the guard 60 from the closest edge of the post 10 is preferably some nine to eleven inches, say, about ten, inches. The members and fittings 62B, 62R, 62P, 62S can be connected with each other or with the post 10 by nuts and bolts and/or lag screws 51, 52, 53, 54. Snow guard support bracket 63 may be provided (FIG. 7). The guard 60 can be mounted any suitable distance 65 higher or lower than the top of the mailbox 12, but preferably is approximately as high as (level with) the mailbox 12 or slightly higher, say, one half of an inch to an inch higher than the mailbox 12 with its bottom, say, some four and one half inches below the bottom of the member 62S. Thus, the mailbox can be well-protected from plowed snow and slush as well as splashed snow, slush, water and mud, with the flag 13 yet being visible by being a distance 66 above the guard 60 when the flag 13 is upraised to signal for outgoing mail. The guard 60 may also serve to carry indicia 67 such as the name and address of a resident, a picture of the resident or his house, a nature or sporting scene, an advertisement, or a political message, which can be provided with added advantage.

The post support 100, collar 180, newsbox post support system 200, and their component(s) may be made of any suitable material. This can include wood, metal and/or plastic. A polyurethane plastic such as a filled structural polyurethane, for example, as found in Jonas, U.S. Pat. No. 5,053,274, may be employed to benefit, especially with the post support 100 and/or components of the newsbox post support system 200 and so forth such as the members 40, 42, 43, 60 (which can otherwise be made, say, of metal); a polyolefin plastic such as polyethylene, polypropylene or combination or variant thereof, or a pressure-treated plywood, may be employed to benefit, especially with components of the newsbox support system 200 and so forth such as the newsbox 50 or snow guard 60. Glass fiber reinforced plastic or polyvinyl chloride are also exemplary. Fasteners such as the fasteners 31, 33, 37, 51, 52, 53, 54, 55 and 56 may be made of any suitable material to include wood, metal and/or plastic. Such fasteners, to include fittings, also may be made of glass fiber reinforced plastic or polyvinyl chloride, or any other suitable material. Parts, say, members 40, 42 and their fittings also can be those known to be commercially available in metal, for example, of 12-, 14- or 16-gauge metal, such as of aluminum (e.g., Aluminum Association Alloy 6053-T6 channel and fabricated parts of Alloy 5052-H32); pre-galvanized steel (e.g., with steel made in accordance with ASTM A-446, Grade A, and mill-galvanized in accordance with ASTM A-525, Designation G-90); hot-dip galvanized after fabrication (e.g., channels with steel meeting ASTM A-570, Grade-33, and ¼-inch fittings formed from ASTM A-635 steel—with hot-dip galvanization in accordance with ASTM A-123); stainless steel (e.g., AISI Type-304 or Type-316), such as available from B-Line Systems, Inc. A preferred material for the members 40, 42, 62 and their associated connecters or fittings is an injection-molded, glass fiber reinforced ultraviolet (UV) stabilized polyurethane (PU) such as the 30% long glass fiber reinforced UV-stabilized PU, AICKINSTRUT non-metallic structures and fasteners (T. J. Cope, Inc., Phila., Pa.). In the latter case, a preferred size for the newsbox fittings is 1½" strut and a preferred size for the guard fittings is 1⅝" strut.

CONCLUSION

The present invention is thus provided. Various features, parts, subcombinations and combinations may be employed with or without reference to other features, parts, subcombinations or practice of the invention, and numerous effected within its spirit, the literal is particularly pointed out as follows:

What is claimed is:

1. A newsbox post support system for supporting a standard newsbox for receipt of a newspaper, advertising sheet, or other material by rural, outdoor delivery, which comprises:

a mailbox support, which can support at least one rural mailbox, and which includes a horizontal support component to provide for a gang-style mailbox arrangement on a horizontal platform; and an, upright newsbox support member, which is a separate member than but attached to the mailbox support such that when attached to the mailbox support the newsbox support member retains a substantial, vertically elongate element member remaining upright but not in contact with the mailbox support to which the upright newsbox support member is attached, and which can support by attachment to the vertically elongate element member at least two standard newsboxes, each of which is for receipt of a newspaper, advertising sheet, or other material by rural, outdoor delivery, mounted in a vertically stacked relationship one to another on the vertically elongate element member of the newsbox support member—wherein the newsbox support member in attached to the mailbox support through the horizontal support component.

2. The system of claim 1, wherein the newsbox support member is made of pieces that include a strut member with at least one of a strut member with a U-shaped cross-section, and a strut member in a form of a substantially square tube having a plurality of holes or slots.

3. The system of claim 1, wherein the at least two newsboxes are attached to the newsbox support member.

4. The system of claim 1, wherein the at least one rural mailbox is attached to the mailbox support.

5. A newsbox support system comprising:

a mailbox support, which can support at least one rural mailbox, and which has at least one support component selected from the group consisting of a vertical support component and a horizontal support component;

an upright newsbox support member, which is a separate member than but attached to the mailbox support such that when attached to the mailbox support the newsbox support member retains a substantial, vertically elongate element remaining upright but not in contact with the mailbox support to which the upright newsbox support member is attached, and which can support by attachment to the vertically elongate element at least two newsboxes mounted in a vertically stacked relationship one to another on the vertically elongate element of the newsbox support member; and a snow guard for guarding from plowed snow embracing a vertically oriented panel having substantially extensive vertical and horizontal dimensions, which is mounted so that the panel is spaced apart from the mailbox support.

6. The system of claim 5, wherein:

the mailbox support includes the vertical support component; and the snow guard is mounted to the vertical support component through a snow guard horizontal stabilizing mount.

7. In combination:

a newsbox support system having:

a mailbox support, which can support at least one rural mailbox, and which includes at least one vertical support component, which is in a form of a post; and an upright newsbox support member, which is a separate member than but attached to the mailbox support such that when attached to the mailbox support the newsbox support member retains a substantial, vertically elongate element remaining upright but not in contact with the mailbox support to which the upright newsbox support member is attached, and which can support by attachment to the vertically elongate element at least two newsboxes mounted in a vertically stacked relationship one to another on the vertically elongate element of the newsbox support member;

plus a weed control collar with a flange having a hole through which the post passes.

8. The combination of claim 7, wherein said hole in the weed control collar is square.

9. The combination of claim 8, wherein the flange of the weed control collar has a substantially circular outer boundary, and a top surface which slopes gently upward with a convex shape included from the outer boundary to the square hole.

10. A newsbox post support system for supporting a standard newsbox for receipt of a newspaper, advertising sheet, or other material by rural, outdoor delivery, which comprises:

a mailbox support, which can support at least one rural mailbox, and which includes a vertical support component in a form of a single post; and an, upright newsbox support member, which is a separate member than but attached to the mailbox support such that when attached to the mailbox support the newsbox support member retains a substantial, vertically elongate element member remaining upright but not in contact with the mailbox support to which the upright newsbox support member is attached, and which can support by attachment to the vertically elongate element member at least two standard newsboxes, each of which is for receipt of a newspaper, advertising sheet, or other material by rural, outdoor delivery, mounted in a vertically stacked relationship one to another on the vertically elongate element member of the newsbox support member.

11. The system of claim 10, wherein the newsbox support member includes a stabilizing mount having a substantially horizontally extending, elongate component, and is attached to the mailbox support through the vertical support component.

12. The system of claim 10, wherein the newsbox support member is made of pieces that include a strut member with at least one of a strut member with a U-shaped cross-section, and a strut member in a form of a substantially square tube having a plurality of holes or slots.

13. In combination, the system of claim 10, further comprising a post support separate from the mailbox support embracing a support body having:

a subsurface contact flange, which can contact the subsurface on or in which the post support is to be mounted; and in connection with the flange a post-receiving restraint, in which the mailbox support in the form of the post is received.

14. The system of claim 10, wherein the at least two newsboxes are attached to the newsbox support member.

15. The system of claim 10, wherein the at least one rural mailbox is attached to the mailbox support.

16. In combination:

the system of claim 10; and a post support separate from the mailbox support embracing a support body having:

a subsurface contact flange, which extends substantially planarly in a first direction to form a peripheral boundary, and which can contact the subsurface on or in which a post is to be mounted; and connected to the flange within the peripheral boundary of the flange, a post-receiving restraint, which has a substantially square shape when viewed from the top, and can receive, closely fit, and restrain the post in a female-to-male, restraint-to-post relationship, from a second direction substantially normal to the first direction, wherein the post is a 4×4 post.

17. The combination of claim 16, wherein the post-receiving restraint is for below ground installation.

18. The combination of claim 17, wherein the flange is provided with a flange recess leading to a shoulder hole for the post-receiving restraint.

19. The combination of claim 18, further comprising a weed control collar that includes a flange having a square hole through which the post may closely pass.

20. The combination of claim 19, wherein the flange of the weed control collar has a substantially circular outer boundary, and a top surface which slopes gently upward with a convex shape included from the outer boundary to the square hole.

* * * * *